US007305909B2

(12) United States Patent
Bollinger

(10) Patent No.: US 7,305,909 B2
(45) Date of Patent: Dec. 11, 2007

(54) ADJUSTABLE WRENCHES

(76) Inventor: Robert Arthur Bollinger, 410 W. 21st St., Lumberton, NC (US) 28358

( * ) Notice: Subject to any disclaimer, the term of this patent is extended or adjusted under 35 U.S.C. 154(b) by 0 days.

(21) Appl. No.: 11/406,102

(22) Filed: Apr. 18, 2006

(65) Prior Publication Data

US 2007/0240546 A1 Oct. 18, 2007

(51) Int. Cl.
*B25B 13/58* (2006.01)

(52) U.S. Cl. ..... 81/185; 81/186; 81/119; 81/DIG. 11

(58) Field of Classification Search ..... 81/185, 81/421, 121.1, 185.1, 185.2, 186, 119, 92, 81/DIG. 11, 125; 269/279
See application file for complete search history.

(56) References Cited

U.S. PATENT DOCUMENTS

| | | | | | |
|---|---|---|---|---|---|
| 102,336 | A | * | 4/1870 | Utley | 81/185 |
| 794,249 | A | * | 7/1905 | Peterson | 81/422 |
| 829,672 | A | * | 8/1906 | Rowell | 81/169 |
| 835,254 | A | * | 11/1906 | Regnell | 81/185 |
| 841,248 | A | * | 1/1907 | Hill | 81/185.2 |
| 953,346 | A | | 3/1910 | Newbauer | |
| 1,018,528 | A | | 2/1912 | Suddarth | |
| 1,080,064 | A | * | 12/1913 | Huber | 81/185 |
| 1,308,440 | A | | 7/1919 | Morrison | |
| 1,483,906 | A | * | 2/1924 | Miller | 81/185 |
| 1,550,564 | A | * | 8/1925 | Nagano | 81/185 |
| 1,625,064 | A | * | 4/1927 | Vello | 81/422 |
| 1,646,140 | A | * | 10/1927 | Dickie | 81/185 |
| 2,855,814 | A | | 10/1958 | Yavner | |
| 2,879,681 | A | | 3/1959 | Blasdell | |
| 3,358,532 | A | * | 12/1967 | Allred | 81/111 |
| 3,717,054 | A | | 2/1973 | Thompson | |
| 3,858,467 | A | | 1/1975 | Evans | |
| 4,315,447 | A | * | 2/1982 | Tartaglia et al. | 81/421 |
| 5,243,883 | A | * | 9/1993 | Savage | 81/421 |
| 5,533,428 | A | | 7/1996 | Pradelski | |
| 5,579,667 | A | | 12/1996 | Kim | |
| 5,768,958 | A | | 6/1998 | Gamble | |
| 6,202,516 | B1 | | 3/2001 | Kim | |
| 6,289,773 | B1 | * | 9/2001 | Patry et al. | 81/185 |
| 6,467,379 | B1 | * | 10/2002 | Wizman | 81/185 |
| 6,945,143 | B2 | | 9/2005 | Kim | |

* cited by examiner

*Primary Examiner*—D. S. Meislin
(74) *Attorney, Agent, or Firm*—Coats & Bennett, P.L.L.C.

(57) ABSTRACT

The present application is directed to adjustable wrenches. In one embodiment, the open-ended wrench includes a head with a opening sized to receive workpieces. One or more shims are attached in an adjustable manner within the opening to alter the width of the wrench.

11 Claims, 5 Drawing Sheets

ADJUSTABLE WRENCHES

BACKGROUND

The present application is directed generally to wrenches and, more specifically, to adjustable open-ended wrenches.

Wrenches are used for a variety of purposes including tightening and loosening workpieces such as pipes, bolts and nuts. Many wrenches include a head having a pair of opposing jaws that are spaced apart to form an opening. A handle may extend from the head for positioning the opening on the workpieces and exerting a force on the workpiece. Use of the open-ended wrench usually includes approaching the workpiece from the side and positioning the opening around the workpiece. Once the opening is positioned, force is applied to the handle to rotate the workpiece.

One type of wrench includes adjustable jaws for adjusting the size of the opening to accommodate different workpieces. One or both of the jaws are laterally adjustable to control a size of the opening. An adjustment mechanism, such as a cylindrical member, is positioned in the head and operatively connected to one or both of the jaws. Rotation of the cylindrical member in a first direction causes the jaws to move laterally outward and increase the size of the opening. Rotation in a second direction causes the jaws to move laterally inward and reduce the opening size.

While adjustable wrenches are desirable for their ability to fit multiple workpieces, there are many disadvantages. A first disadvantage is the wrenches may be larger than fixed-sized wrenches. The adjustable wrench usually includes a large head sized to accommodate the jaws at a distance to fit the largest workpiece. Further, adjustable wrenches may be expensive due to increase complexity of the movable jaws and rotating cylinder.

SUMMARY

The present application is directed to adjustable wrenches. In one embodiment, the open-ended wrench includes a head with an opening sized to receive workpieces. One or more shims are attached in an adjustable manner within the opening to alter the width of the wrench. The shims may be adjustable between first and second positions to adjust an overall width of the opening.

DETAILED DESCRIPTION

The present application is directed to adjustable wrenches including a opening with one or more adjustable shims. The shim or shims is selectively movable to alter the size of the opening to accommodate workpieces of different sizes.

Figure 1A:
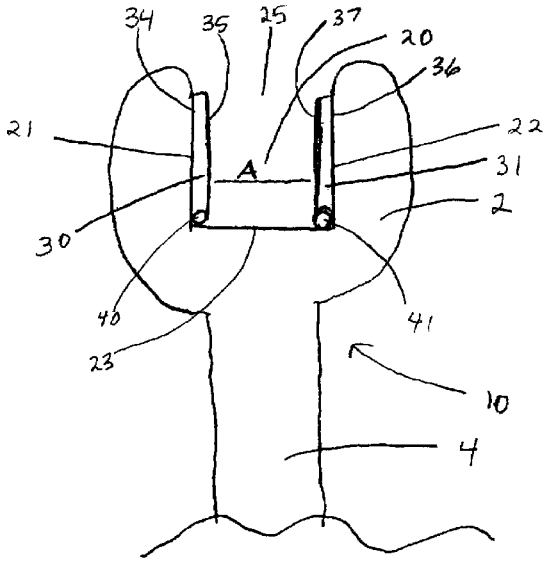
FIG. 1A is a side schematic view illustrating a wrench with shims in a first position according to one embodiment.

FIG. 1A illustrates one embodiment of a wrench including a body 10. The body 10 includes a head 2 and an integral handle 4. The head 2 further includes an opening 20 formed by sidewalls 21 and 22 and a third wall 23. The opening 20 includes an open end 25 that generally faces away from the handle 4. Shims 30, 31 are attached to the opening 20 and are pivotally connected to the head 2 at connectors 40 and 41 respectively. Shims 30 and 31 are movably positioned to adjust a size of the opening 20.

The wrench body 10 includes a head 2 and a handle 4. The handle 4 provides a means to grasp the wrench. The handle 4 extends in an opposite or angled direction from the open-end 25. Handle 4 may further include an end (not illustrated) or a second head (not illustrated) positioned opposite from the head 2.

The head 2 includes the opening 20 formed by sidewalls 21, 22. In one embodiment, sidewalls 21, 22 are in an opposing arrangement and substantially parallel to each other. A lower sidewall 23 may extend between the sidewalls 21, 22 and connects at corners. In one embodiment, the lower sidewall is substantially perpendicular to the sidewalls 21, 22.

In one embodiment, shims 30, 31 are connected to the head 2. The shims 30, 31 may have the same or different shapes and sizes. In one embodiment, shims 30, 31 include different thicknesses. In one embodiment, one or both of shims 30, 31 are shaped to abut against the sidewalls 21, 22, and may be substantially flat. In one embodiment, connectors 40, 41 attach the shims 30, 31 to the head 2. Connectors 40, 41 may be positioned at or near the intersection of sidewalls 21, 22 and the third wall 23. The connectors 40, 41 pivotally connect the shims 30, 31 to be selectively positioned from a first position at or near sidewalls 21, 22 to a second position at or near the third wall 23.

FIG. 1A illustrates a two-shim embodiment with each of the shims 30, 31 in a first position. Side 34 of shim 30 is in proximity to the sidewall 21 and side 36 of shim 31 is in proximity to the sidewall 22. In one embodiment, the shims 30, 31 contact the sidewalls 21, 22. With the shims 30, 31 in this orientation, the opening 20 has a width A.

Figure 1B:
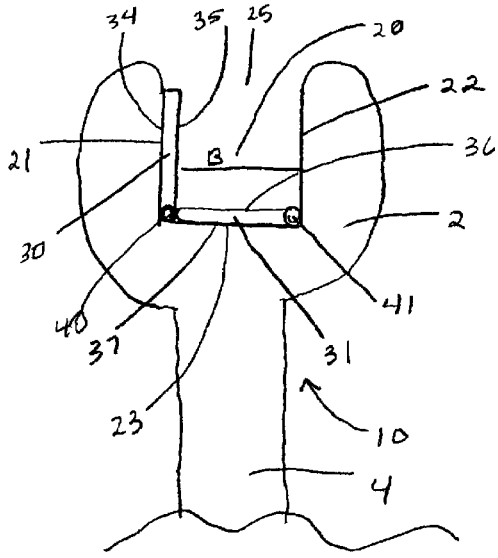
FIG. 1B is a side schematic view illustrating the wrench with the shims in a second position according to one embodiment.
Figure 1C:
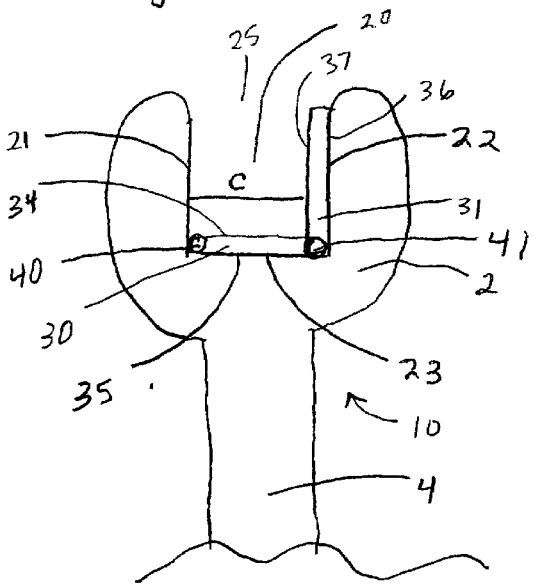
FIG. 1C is a side schematic view illustrating the wrench with the shims in a third position according to one embodiment.

FIG. 1B illustrates shim 30 in the first position at the sidewall 21, and shim 31 in a second position at the third wall 23. With the shims 30, 31 in this orientation, the opening 20 has a width B. FIG. 1C illustrates shim 31 in a first position at the sidewall 22, and shim 30 in the second position at the third wall 23. In the orientation of FIG. 1C, the opening 20 has a width C. In this embodiment, a thickness of shim 30 is different than the thickness of shim 31. Therefore, width B as illustrated in FIG. 1B is different from width C as illustrated in FIG. 1C.

Figure 1D:
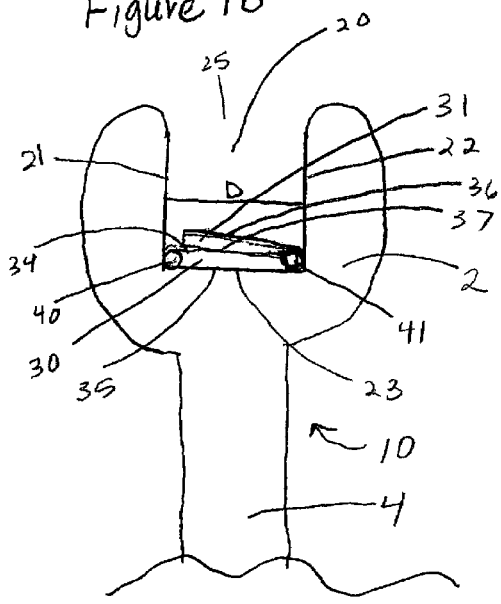
FIG. 1D is a side schematic view illustrating the wrench with the shims in a fourth position according to one embodiment.

FIG. 1D illustrates the shims 30 and 31 in the second position at the third wall 23. In this embodiment, shim 30 is pivoted at connector 40 to fold down upon or near the third wall 23. Shim 31 is pivoted at connector 41 to fold down upon or near side 34 of shim 30. In this orientation, opening 20 has a width D. The embodiment of FIGS. 1A-1D accommodates four separate widths with a single wrench 10.

In one specific embodiment, the opening 20 is about 16 millimeters (mm). Shim 30 has a thickness of about 1 mm, and shim 31 has a thickness of about 2 mm. When both shims 30, 31 are up as illustrated in FIG. 1A, opening 20 has a width of about 13 mm. When shim 30 is up and shim 31 is down as illustrated in FIG. 1B, the opening 20 has a width of about 15 mm. When shim 31 is up and shim 30 is down as illustrated in FIG. 1C, the opening 20 has a width of about 14 mm. When both shims 30, 31 are down as illustrated in FIG. 1D, the opening 20 has a width of about 16 mm. In one embodiment, a second opening (not illustrated) is positioned on the opposite side of the handle 4. The second opening may also include two shims with the second opening and two shims being different sizes to adjust the second opening to four separate sizes. Therefore, a single wrench may accommodate eight different sizes.

Figure 2:
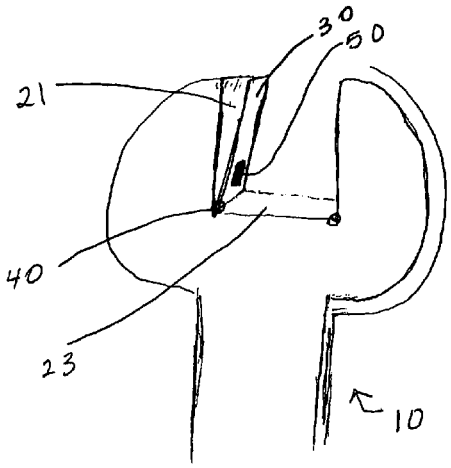
FIG. 2 is a perspective view illustrating a wrench according to one embodiment.

FIG. 2 illustrates another embodiment with a single shim 30. This wrench 10 is adjustable between two widths. A first width with the shim 30 at the sidewall 21 and a second width with the shim 30 at the third wall 23.

Figure 3:
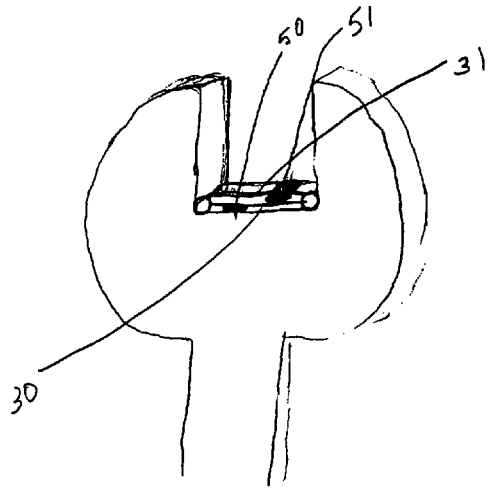
FIG. 3 is a perspective view illustrating a wrench according to one embodiment.

In one embodiment as illustrated in FIG. 2, a magnet 50 may be attached to the shim 30. Magnet 50 may be positioned at a bottom section of shim 30 towards the connector 40 to lessen the likelihood that the magnet 50 will interfere with the workpiece. Magnet 50 may also maintain the shim 30 in proximity to the bottom wall 23. FIG. 3 illustrates an embodiment including a magnet 50, 51 positioned on the bottom section of each of the shims 30, 31. The magnets 50, 51 secure both shims 30 and 31 in a second position and keep them from interfering with a workpiece. In one embodiment, one or more magnets may be positioned on or near the surface of sidewalls 21, 22 or third wall 23.

In another embodiment, the shim 30 or shims 30, 31 are magnetized to be attracted to the sidewalls. In a specific embodiment, these members are partially magnetized with a lower section being magnetized and an upper section being non-magnetized.

Figure 4:
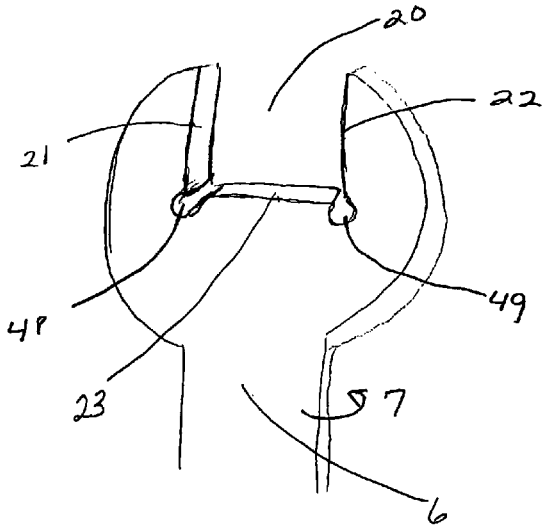
FIG. 4 is a perspective view illustrating a wrench with the shims removed according to one embodiment.

FIG. 4 illustrates an embodiment of an alternative configuration of the opening 20. Recesses 48, 49 are positioned for placement of connector mechanisms at or near the points where sidewalls 21 and 22 intersect with third wall 23. The recesses 48, 49 can extend from a front face 6 to a back face 7. Recesses 48, 49 may also extend into the opening 20 as in FIG. 4, or may be spaced from the opening 20. A variety of different connector mechanisms may be housed in these recesses 48, 49 including, but not limited to, hinges, screws, bolts, fasteners, pins, springs and gears.

Figure 5:
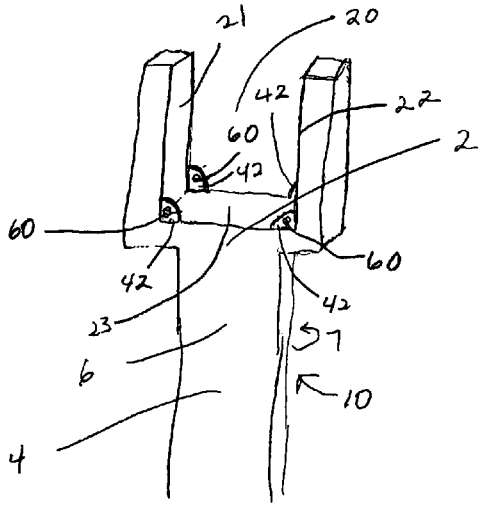
FIG. 5 is a perspective view illustrating a wrench with the shims removed according to one embodiment.

FIG. 5 includes shoulders 42 for attaching the shims 30, 31 to the head 2. The shoulders 42 are placed at or near the points where sidewalls 21 and 22 meet third wall 23 and provide a means whereby the shims 30, 31 can be positioned in the opening 20 for pivoting action. In this embodiment, the shoulders 42 are integral with the front and back faces 6, 7 respectively. However, the shoulders 42 may be placed in alternative positions for ease of pivoting action or for placement of the shims in the first and second positions. Apertures 60 may be positioned in the shoulders 42 for receiving a pin, screw or other securing means to attach the shims 30, 31.

Figure 6:
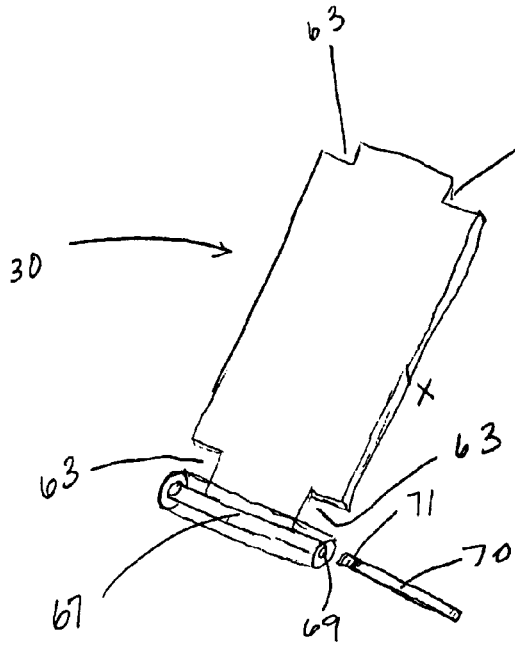
FIG. 6 is an exploded perspective view illustrating a shim and a hinge pin according to one embodiment.

FIG. 6 illustrates an embodiment of a shim 30 that is substantially flat with a thickness X. Notched portions 63 are positioned on each corner and sized to fit between the shoulders 42. A cylindrical pivoting section 67 is positioned at one end of the shim 30 and is sized to fit within recesses 48, 49. Pivoting section 67 may also include an aperture 69 that extends throughout its length. Aperture 69 is sized to receive a pin 70 that secures the shim 30 to the shoulders 42. The pin 70 may include threads 71 or either bradding on one or both ends to maintain the pin 70 in position after insertion.

Figure 7:
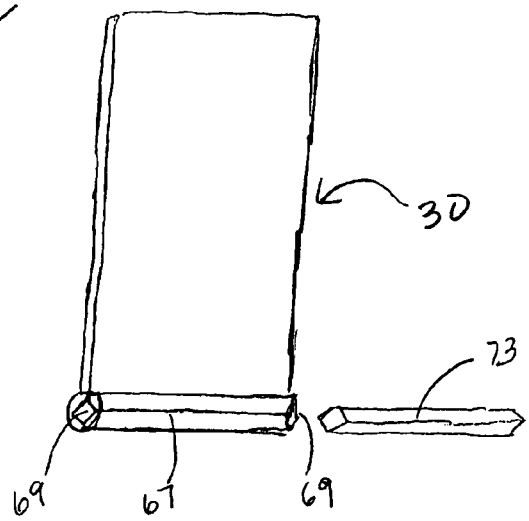
FIG. 7 is an exploded perspective view illustrating a shim and a hinge pin according to one embodiment.

FIG. 7 illustrates another embodiment of a pivoting section 67 positioned at a bottom of the shim 30 and includes an aperture 69 sized and shaped to receive a rectangular pin 73. In this embodiment, pin 73 includes a rectangular cross-sectional shape that matches the shape of the aperture 69.

Figure 8:
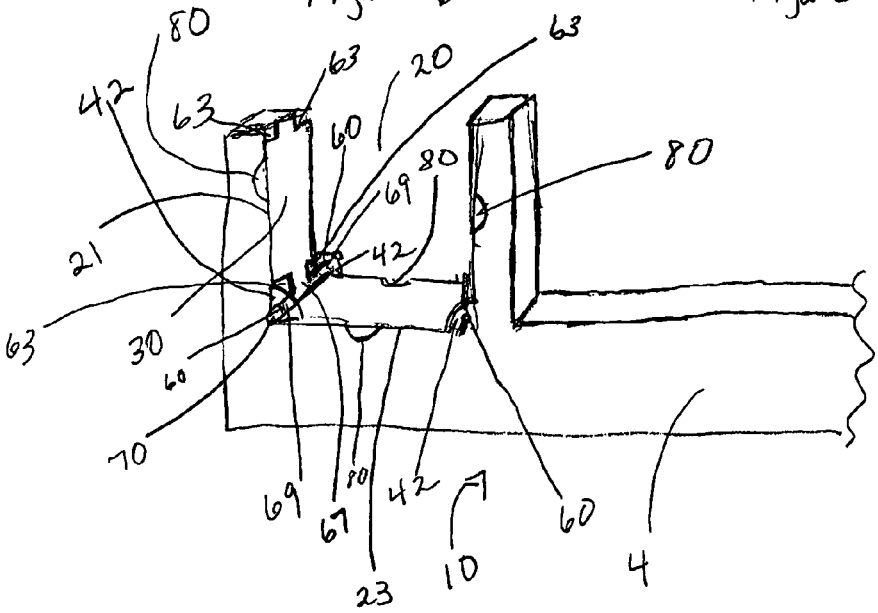
FIG. 8 is a perspective view illustrating a wrench according to one embodiment.

FIG. 8 illustrates an embodiment including a handle 4 orientated approximately 90 degrees from a central line of the opening 20. The shim 30 is sized to fit against the sidewall 21 with a pin 70 extending through the aperture 69 of the pivoting section 67 and the apertures 60 in the shoulders 42. The shim 30 is pivotally secured and movable from the first position at the sidewall 21 as illustrated in FIG. 8 to the second position at the third wall 23. The notches 63 are sized to allow the shim 30 to fit against sidewall 21 and the third wall 23 without interfering with the shoulders 42. In one embodiment, the notches 63 are at least as deep as the thickness of the shoulders 42 to allow such unimpeded movement.

One or more indents 80 are positioned in one or more of the sidewalls 21, 22 and third wall 23. The indents 80 are sized for a user to grasp or position an instrument to contact and apply force to move the shim 30 between the positions. The indents 80 may be useful to pry the shim 30 from the surface of the sidewall 21 or third wall 23 if magnets 50 or other means are used to secure the shim 30 in the first or second position.

Figure 9B:
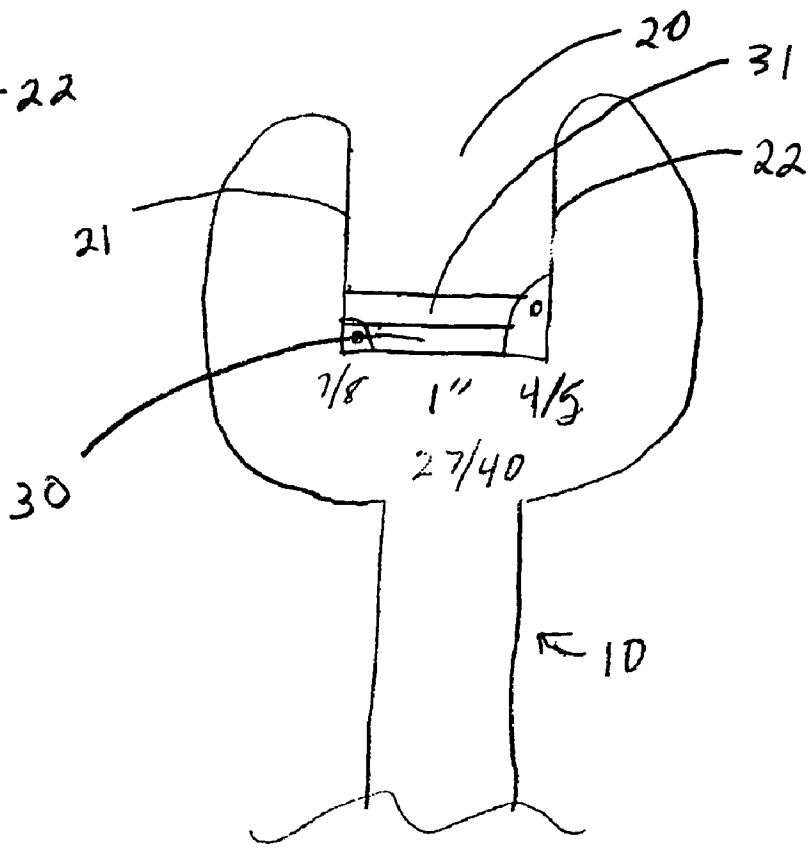
FIG. 9B is a side schematic view illustrating a wrench according to one embodiment.
Figure 9A:
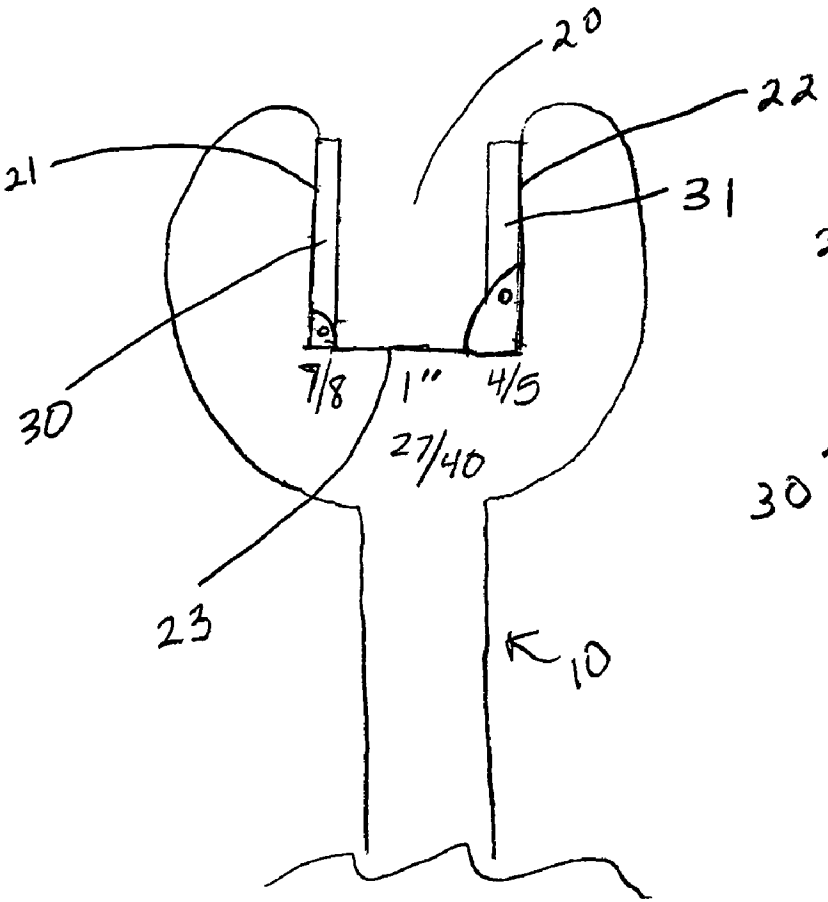
FIG. 9A is a side schematic view illustrating a wrench according to one embodiment.

FIGS. 9A and 9B illustrate an embodiment with the shims 30, 31 pivotally connected at different heights relative to the third wall 23. Shim 30 is connected at a first height and shim 31 is connected at a second, greater height. As illustrated in FIG. 9A, the different heights do not affect the positioning of the shims 30, 31 in the first position. As illustrated in FIG. 9B, the different heights provide for the shims 30, 31 to be stacked evenly in an overlapping arrangement. In one embodiment, the shims 30, 31 remain in contact substantially across the entire length. This minimizes the height of the stacked shims 30, 31 providing ample room in the opening 20 to receive the workpiece. In one embodiment, the shims 30, 31 are pivotally connected at a point spaced outward from the sidewalls 21, 22 respectively to remain in contact along the length of the sidewall. Therefore, a shim with a larger thickness will be pivotally connected at a point further from the sidewall than a shim with a smaller thickness.

Figure 10:
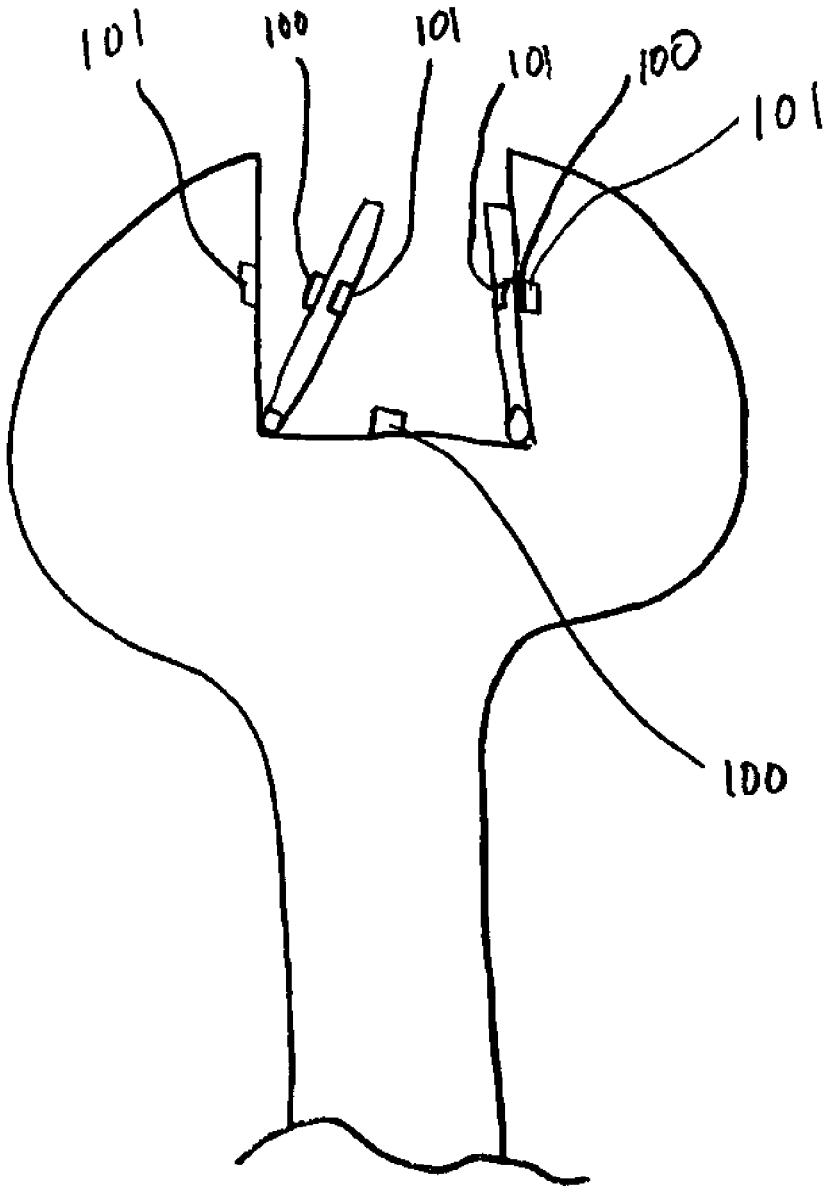
FIG. 10 is a side schematic view illustrating a wrench according to one embodiment.

FIG. 10 includes an embodiment with male snaps 100 and female snap 101. A male snap 100 is connected to the third wall 23, and female snaps 101 are connected to the sidewalls 21, 22. Each shim 30, 31 includes a combination male/female snap 100, 101. The shims 30, 31 with the combination snaps 100, 101 engage the snaps 100, 101 on the sidewalls 21, 22, and third wall 23 to maintain their positions. Further, the combination male/female snaps 100, 101 on the shims 30, 31 may connect together when each of the shims 30, 31 is positioned at the third wall 23.

One embodiment may also include more than one opening per wrench. Additionally, more than one shim may be pivotally connected to a single connector, increasing the number of possible wrench sizes. In one embodiment, indicia may be positioned on the front and/or back face 6, 7 indicating the widths of the opening 20.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An adjustable wrench comprising:

an elongated handle;

a head connected to the handle and including a opening formed between a first and a second opposing sidewall and a third sidewall;

a first shim pivotally mounted to the head and positioned within the opening, the first shim movable between a first position against the first sidewall and a second position at the third sidewall;

a second shim pivotally mounted to the head and positioned within the opening, the second shim movable between a first position against the second sidewall and a second position at the third sidewall; and the first shim and the second shim oriented in an overlapping arrangement at the third sidewall in a third position.

2. The wrench of claim 1, wherein the third sidewall is substantially perpendicular to each of the first and second sidewalls.

3. The wrench of claim 1, wherein the first shim is connected to the head at a corner formed between the first sidewall and third sidewall, and the second shim is connected to the head at a corner formed between the second sidewall and the third sidewall.

4. The wrench of claim 3, further comprising a magnet positioned within each of the first shim and the second shim to maintain the first shim and the second shims in their respective first and second positions.

5. The wrench of claim 1, wherein the second shim has a thickness different than the first shim.

6. The wrench of claim 1, wherein the first shim is mounted to the head at a point further from the handle than the second shim.

7. An adjustable wrench comprising:

a head;

a opening positioned within the head and including a first and second opposing sidewalls and a lower sidewall, the opening having an open end opposite from the lower sidewall;

a first shim pivotally connected within the opening and movable from the first sidewall to the lower sidewall;

a second shim pivotally connected within the opening and movable from the second sidewall to the lower sidewall, the second shim including a different thickness than the first shim;

the opening being adjustable between a first width with both the first shim and the second shims positioned at the lower sidewall, a second width with the first shim positioned at the first sidewall and the second shim positioned at the lower sidewall, a third width with the second shim positioned at the second sidewall and the first shim positioned at the lower sidewall and a fourth width with the first shim positioned at the first sidewall and the second shim positioned at the second sidewall;

wherein each of the first, second, third, and fourth widths are different; and wherein the first and second shims are in an overlapping arrangement when both are positioned at the lower sidewall.

8. The wrench of claim 7, wherein each of the first and second shims are movable through a range of about 90°.

9. The wrench of claim 7, wherein the first shim is mounted closer to the lower sidewall than the second shim.

10. The wrench of claim 7, wherein the first and second shims are partially magnetized.

11. The wrench of claim 7, further comprising connectors to connect the first and second shims to the head, each of the connectors comprising a pin that extends within the opening and operatively connects the first and second shims to the head.

* * * * *